United States Patent [19]

Santamaria

[11] Patent Number: 4,600,411

[45] Date of Patent: Jul. 15, 1986

[54] PULSED POWER SUPPLY FOR AN ELECTROSTATIC PRECIPITATOR

[75] Inventor: George T. Santamaria, Solana Beach, Calif.

[73] Assignee: Lucidyne, Inc., San Diego, Calif.

[21] Appl. No.: 597,506

[22] Filed: Apr. 6, 1984

[51] Int. Cl.[4] ..... B03C 3/68

[52] U.S. Cl. ..... 55/139; 307/108; 363/27

[58] Field of Search ..... 323/903; 363/27, 135; 55/105, 139; 361/235; 307/108

[56] References Cited

U.S. PATENT DOCUMENTS

| | | | |
|---|---|---|---|
| 3,641,740 | 2/1972 | Schumann et al. | 55/105 |
| 3,849,670 | 11/1974 | Lourigan | 55/139 |
| 3,981,695 | 9/1976 | Fuchs | 55/138 |
| 3,984,215 | 10/1976 | Zucker | 55/2 |
| 4,052,177 | 10/1977 | Kide | 55/139 |
| 4,061,961 | 12/1977 | Baker | 323/21 |
| 4,107,757 | 8/1978 | Masuda et al. | 361/235 |
| 4,232,355 | 11/1980 | Finger et al. | 55/139 |
| 4,386,395 | 5/1983 | Francis et al. | 363/135 |
| 4,390,831 | 6/1983 | Byrd et al. | 323/240 |
| 4,400,662 | 8/1983 | Coe | 55/139 |
| 4,558,404 | 12/1985 | James | 55/105 |

FOREIGN PATENT DOCUMENTS

| | | | |
|---|---|---|---|
| 33035 | 3/1977 | Japan | 307/108 |

*Primary Examiner*—William H. Beha, Jr.
*Attorney, Agent, or Firm*—Fitch, Even, Tabin & Flannery

[57] ABSTRACT

A method and apparatus for generating a supply of pulsed power to an electrostatic precipitator where a residual collection field is maintained on the electrodes during interpulse periods while, in addition, high voltage pulses in excess of the residual are periodically impressed on the electrodes. The apparatus includes a series tuned circuit having a pulse forming section which creates a single damped cycle of oscillation to produce ionization current from a corona discharge electrode before unused power is returned to the pulse forming section. A blocking diode prevents the voltage on the precipitator from falling below the corona threshold voltage, and a series tuned trap circuit maintains the diode in conduction during pulsing to allow the return of unused energy.

30 Claims, 11 Drawing Figures

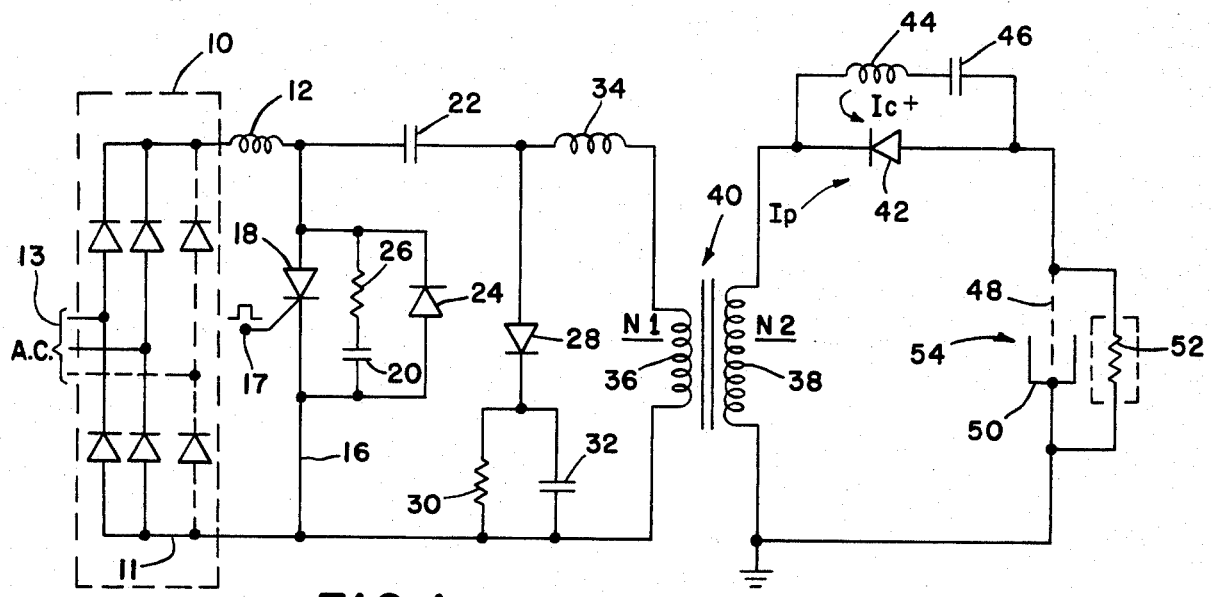
FIG. 1
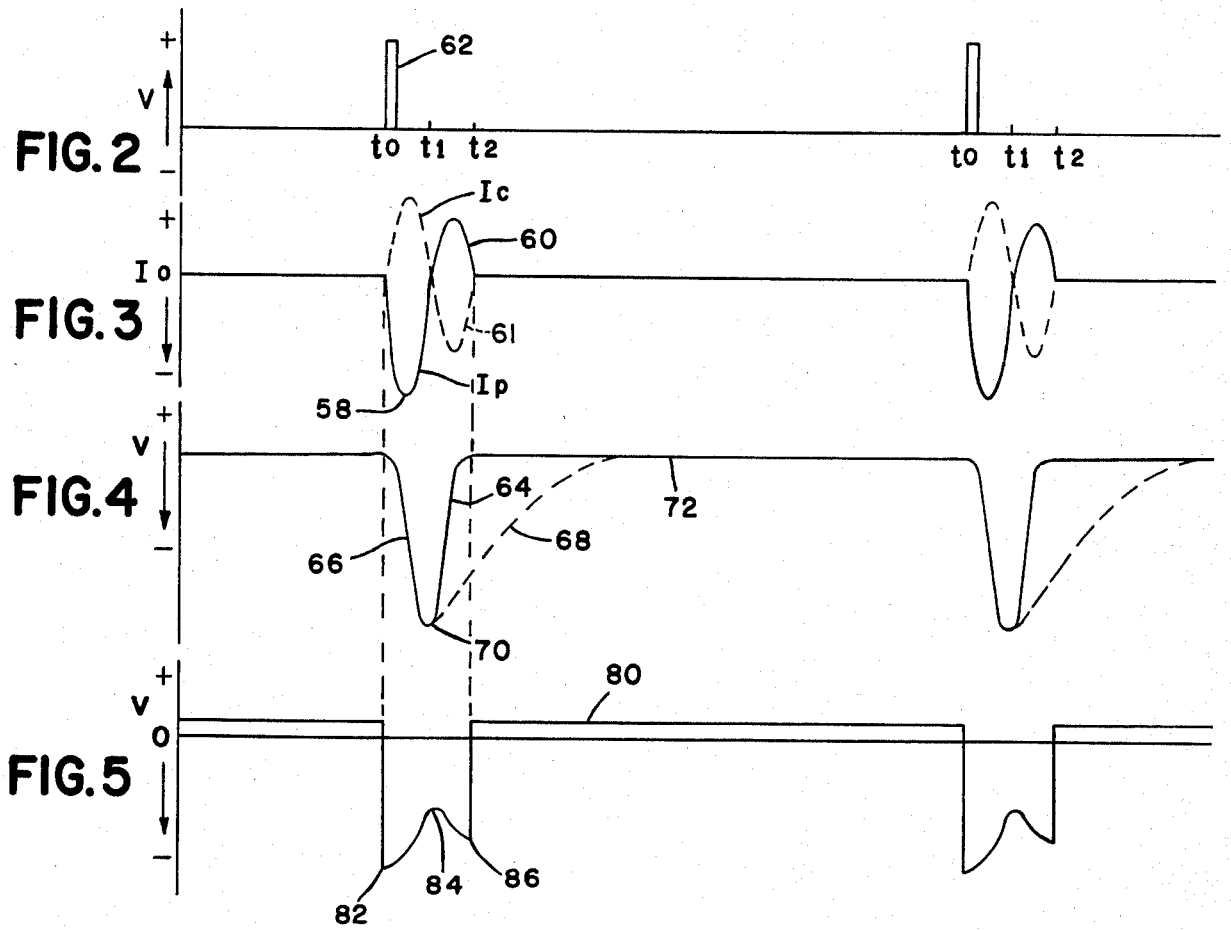

PULSED POWER SUPPLY FOR AN ELECTROSTATIC PRECIPITATOR

BACKGROUND OF THE INVENTION

The invention pertains generally to a pulsed power supply for capacitive loads, such as an electrostatic precipitator, and is more particularly directed to such power supplies with means for providing efficient energy transfer from a single supply which produces a peak pulse voltage and a residual interpulse voltage.

Conventionally electrostatic precipitators are used for scrubbing effluents or other fluids which contain particulate debris. The distribution of particles entrained in a carrier fluid, usually a waste gas or polluted air etc., can be reduced significantly by charging the particulate matter with ionized charges to where they obtain a specific polarity. The charged particulates are then moved under the influence of a high voltage electrostatic field to where they are precipitated on a collector plate of the opposite polarity. In general, many precipitators use a negatively charged electrode (cathode) at a high voltage to generate an ionizing cloud of electrons and a positively charged electrode (anode) to collect the particulates. The cathode generally uses the corona discharge method to form an ionizing cloud of electrons which charge the particulates with a negative polarity. The particulates are then moved to the positive collecting plate by the forces generated by the collection field formed between the anode and cathode.

The method by which power is supplied to an electrostatic precipitator is critical to the efficient operation of the precipitator for collecting the particles, and for the minimum use of power by the supply. In the past, dual pulsed power supplies have been shown to be advantageous where a high voltage DC collection field is impressed across the precipitator plates by one power supply, and thereafter a high voltage pulse generated by another power supply superimposed thereon. The superimposed pulses enhance the creation of ions with which to charge particulates and the high voltage collection field maintained between pulses, the interpulse voltage, provides an efficient means to produce high collection forces on the particulates.

The prior art dual supply systems, while providing the advantages of a pulsed supply to increase the efficiency of the collection process are, however, disadvantageous for at least two reasons. Initially, the high voltage DC supply, which generates the collection field, is usually formed of a transformer-rectifier set which has a low output impedance. When a voltage in excess of the breakdown voltage is impressed across the precipitator plates, an arc may form thereby drawing excessive amounts of power from the collection field supply. In addition, in these dual supplys excessive numbers of high voltage components are needed for the transformation of the line voltage to the high tension precipitator voltages, which can be several tens of KV in magnitude. It would, therefore, be advantageous and more economical to provide a collection field with a superimposed pulse voltage from a single composite supply which, in addition, employs fewer components.

It is known in such pulsed precipitators that the efficiency of the precipitator itself increases with increasing pulse voltage. This is accounted for because the corona discharge current generates an increasing number of charges as the voltage increases. However, with increased voltage there is also an increased probability of a spark forming. Modern pulsed generators attempt to solve this problem by providing a narrow pulse width which, although in excess of the breakdown or the sparking voltage of the precipitator, is narrow enough in time duration to prevent a spark from forming. Therefore, an efficient precipitator power supply should supply the voltage pulses at a peak value in excess of the DC breakdown voltage to generate increased ionization but short enough in duration to prevent sparking.

To provide a truly efficient power supply for electrostatic precipitators, the nature of the precipitator load presented to the power supply should also be taken into account. The precipitator can be viewed as a capacitive load having a nonlinear resistance in parallel therewith. The capacitance of the precipitator stores the voltage impressed thereon as a collected charge, and dissipates a portion of the charge while generating the corona discharge current during pulse periods. This discharge current of the corona electrode is the real part of the power dissipated by the precipitator which, in addition, may dissipate any unused reactive portion of the power delivered to it as heat. Therefore, a power supply having means to return unused power from the precipitator to the charging supply would greatly enhance the efficiency of the system. If this unused energy component can be returned to the power supply before it is dissipated as heat, then the actual power required by the precipitator can be reduced.

Some power supplies return unused energy from a capacitive load such as resonant supplies. These resonant supplies are however used in other high power applications such as radio transmitting equipment. These supplies are generally disadvantageous for precipitators because they lack a means to maintan a voltage between pulses for particle collection. It is known that the collection field on a precipitator during the interpulse period should be maintained at or near the corona threshold value where ions are emitted.

SUMMARY OF THE INVENTION

The invention provides a pulsed power supply for a capacitive load, such as an electrostatic precipitator, where a residual voltage is retained on the load in addition to the superimposition of pulse voltage peaks substantially in excess of the residual value.

It is an object of the invention to supply charging energy for maintaining a capacitive load at a residual voltage value while applying periodic pulse voltages from a single composite power supply.

It is yet another object of the invention to supply the residual voltage and the periodic peak voltages from a pulsed power supply in an efficient manner.

When used as an electrostatic precipitator power supply, it is still another object of the invention to supply the periodic peak voltages as narrow pulses having a peak voltage in excess of the precipitator DC break down voltage, but not of such duration to cause sparking.

When used as an electrostatic precipitator supply, it is yet another object of the invention to provide a pulsed power supply which does not continue to deliver unlimited power when a spark occurs across the precipitator thereby allowing the spark to extinguish.

In a preferred implementation the invention comprises a current source for charging an energy storage element with a predetermined amount of charge; a pulse transformer having a primary winding and a secondary winding with the transformer being connected through its primary to the energy storage element, such that discharge of the energy stored in the element will create a primary current pulse in the primary winding; means interposed between the primary winding and the energy storage element for connecting a conduction path between the element and primary to cause the generation of the primary current pulse; means coupled to the connecting means for triggering the connecting means into conduction periodically; wherein the primary current pulse induces in the secondary winding a secondary current pulse that is applied to the capacitive load to impress a voltage thereon, the capacitive load thereafter creating a return current pulse thereby lowering the voltage thereon; and bidirectional conduction means interposed between the capacitive load and the secondary winding providing a low impedance conduction path during the secondary current pulse and during the return current pulse, and a high impedance current path otherwise.

The bidirectional conduction means, by providing a low impedance path during the secondary pulse and the return pulse, permits the unused energy transmitted to the capacitive load during pulsing to be returned through the pulse transformer in an efficient manner instead of being dissipated as heat in the load.

Additionally, by returning the return pulse, the power supply advantageously generates a narrow voltage pulse to a capacitive load which can be used in an electrostatic precipitator application to increase collection efficiency.

The bidirectional conduction means, by providing a high impedance other than during the secondary current pulse and return pulse, will allow a residual voltage to remain on the capacitive load which, in an electrostatic precipitator application, is useful for providing a collection field just below the corona threshold voltage during interpulse periods.

The bidirectional conduction means, by providing the transfer of impedance from a high value to a low value, depending upon the conditions present in the system, further provides an advantageous means for charging the capacitive load to a residual voltage while supplying the peak pulse voltage with a single composite supply.

BRIEF DESCRIPTION OF THE DRAWINGS

These and other objects, features, and aspects of the invention will become more apparent and more clearly defined if a reading of the following detailed description is taken in conjunction with the accompanying drawings, in which:

FIG. 1 is a detailed electrical schematic diagram of a pulsed power supply for a capacitive load, such as an electrostatic precipitator, constructed in accordance with the invention;

FIG. 2 is a waveform diagram illustrating the form of the triggering pulses as a function of time for the power supply illustrated in FIG. 1;

FIG. 3 is a waveform diagram illustrating the circulating current for the trap elements and secondary winding pulse current for the power supply illustrated in FIG. 1;

FIG. 4 is a waveform diagram illustrating the voltage across the precipitator as a function of time as generated by the power supply illustrated in FIG. 1;

FIG. 5 is a waveform diagram of the voltage appearing across the surge inductor and the primary winding of the pulse transformer illustrated in FIG. 1; and FIGS. 6–12 are alternative embodiments of the pulse forming network illustrated in FIG. 1.

DETAILED DESCRIPTION OF THE PREFERRED EMBODIMENT

Figure 6:
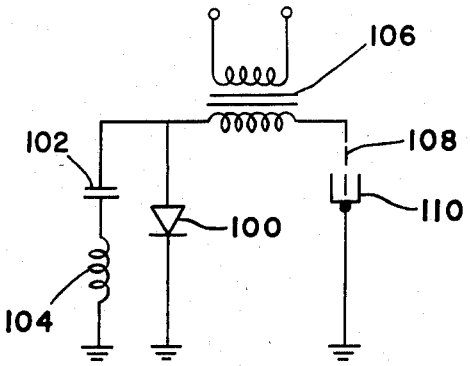

In FIG. 1 there is illustrated a preferred implementation of a pulsed power supply circuit for energizing a capacitive load, such as an electrostatic precipitator. In accordance with one of the objects of the invention, the power supply efficiently transforms a AC voltage from a power source 10 into a pulsed signal supplying a precipitator 54 with a residual collection voltage, and superimposed thereon, narrow high voltage pulse providing corona charging current for ionization of the particulate matter passing through the precipitator. Although the power supply will be described with respect to an advantageous application using an electrostatic precipitator, it should be realized that other capacitive loads may be energized in a similar manner by the invention.

A conventional power source for a precipitator power supply generally consists of a transformer connected to the AC power line to provide isolation. Normally, one or more voltage steps up from the line voltage can be provided, if desired, by serially connecting the output of one step-up transformer to another, or providing one transformer with a large turns ratio. The present invention however contemplates a reduction of circuit components, and a main voltage step up as near to the precipitator input as possible to reduce the number of components that necessitate a high voltage rating.

Therefore, in a preferred form, the power source 10 comprises a rectifier bridge 11, either single or polyphase, directly connected to the terminals of the AC mains 13. In series with the bridge 11 is a charging inductor 12 connected to one terminal of a charging capacitor 22. The negative terminal of the rectifier bridge is connected to a point in the circuit hereafter referred to as common. This point may or may not be grounded depending on the requirements of power source 10. The resonant half-period of the inductor 12 and the capacitor 22 is adjusted to be substantially longer than the output pulse period which will be described hereinafter. The circuit characteristics are set for the power source 10, charging inductor 12, and capacitor 22 are such that the output pulse repetition frequency of the pulsed power supply is independent of the AC mains frequency. With a 480 VAC mains and full wave rectification as illustrated, the source 10 would produce a charging voltage of 600–700 V on the capacitor 22.

The other terminal of the capacitor 22 is connected, through a surge inductor 34, to one terminal of the primary winding 36 of a pulse transformer 40, whose other terminal is connected to the common terminal. The pulse transformer 40 preferably produces a step up in voltage of approximately 50–100 providing an output of 30 kV to 60 kV from the 600 V on the capacitor 22. The path through the inductor 12, capacitor 22, and the primary 36 winding allows the rectified AC cycles of power source 10 to charge the capacitor 22. Since the charging capacitor 22 is of a particular value and the voltage input to the capacitor attains a known peak value, the quantity of energy or charge stored on the capacitor is determinable by the equation $Q=\frac{1}{2}CV^2$ where:

Q=quantity of charge in Joules

C=capacitance of capacitor 22 in Farads

V=the peak voltage output from the power source 10.

During charging of the capacitor 22 most of the current in the capacitor flows through diode 28 and resistor 30 before being returned to the power source. Because of this arrangement, there is no direct connection between the precipitator and the power source and thus the tendency for sparks to become self sustaining arcs is eliminated.

A discharge path or switching path for the capacitor 22 is provided by a thyristor, preferably a silicon controlled rectifier (SCR) 18. The SCR 18 is poled by connecting its anode terminal to the junction of the inductor 12 and the capacitor 22, and its cathode terminal to the common terminal, such that a positive current flow from its anode to its cathode will be produced when the device is triggered into conduction. The device is triggered into conduction by applying a positive voltage between its gate terminal 17 and the cathode terminal 16.

The triggering pulses can be applied from a source which is variable in frequency, depending upon the required pulse repetition frequency in the output voltage. Normally, the triggering pulses are applied at a frequency to provide adequate energy to provide adequate charging current for the corona electrode to charge particles flowing through the precipitator. The interpulse periods provided between triggering pulses are, however, long enough to permit re-energization of the charging capacitor 22 by the source 10 after its periodic discharge. In the preferred implementation, pulses are applied at a pulse repetition frequency of approximately 400 Hz with a period on the order of 200 microseconds. As will be more fully explained hereinafter, increasing the triggering pulse frequency will cause more energy to be transferred to the precipitator.

Forming a parallel path with the SCR 18 is a bypass diode 24. The bypass diode 24, oppositely poled to the SCR 18, performs the function of making the switching path between the capacitor 22 and ground bidirectional. Additionally, in parallel with the SCR 18 and the bypass diode 24, is a serially connected resistor 26 and a capacitor 20. The resistor 26 and the capacitor 20 form a damping or snubber network to limit the rate of rise of forward voltage across SCR 18 at turnoff and thereby prevent the triggering the SCR without a triggering signal.

Connected between the junction of the surge inductor 34 and the charging capacitor 22, is a clamping network comprising a clamping diode 28 and a parallel combination of a resistor 30 and a capacitor 32. The clamping network prevents the voltage across the inductor 34 and the primary winding 36 of the pulse transformer from rising to a positive polarity greater than a clamping voltage 80 (FIG. 5). The clamping voltage 80 is developed across the resistor 30 and the capacitor 32 when the diode 28 becomes conducting upon positive voltage excursions of the inductance of the primary winding 36.

The second portion of the power supply circuit includes a means for applying the pulses which were developed by the first portion of the power supply to the precipitator 54, and for maintaining a residual field between pulses so that the precipitator can collect particles with that field. The second portion of the circuit comprises a secondary winding 38 of the pulse transformer, which is connected in series with the precipitator 54. Interposed between a cathode 48 of the precipitator and one terminal of the secondary winding 38 is a blocking diode 42. The blocking diode 42 is poled such that negative current pulses can pass through it to charge the cathode 48 to a high negative voltage without allowing the passage of current in the opposite direction. The diode thus blocks DC current flow through the secondary winding 38 and permits a residual voltage to be maintained on the precipitator.

The collecting electrode of the precipitator or anode 50 is normally connected to ground commonly with the other terminal of the secondary winding 38. In parallel with the cathode 48 and anode 50 of the precipitator 54 is illustrated a non-linear resistor 52 in the dashed area. The non-linear resistor 52 represents the resistance or dielectric strength of the medium forming a capacitive load between the cathode and the anode. When the precipitator 54 has a voltage placed thereon which is less than the corona threshold voltage, no ionization of the surrounding particles will take place as no electrons are emitted from the cathode. The non-linear resistor 52, therefore, appears to have an infinite impedance in this condition. As corona charging current begins to flow because of an increase in voltage over the threshold as a result of a pulse supplied thereto, the charging current increases greatly and the apparent resistance of the non-linear element 52 markedly decreases. During a spark condition, the resistance 52 appears to be a short circuit.

Connected in parallel across the blocking diode 42 is a series connection of a trap inductor 44 and a trap capacitor 46. The trap inductor 44 and trap capacitor 46 form a series tuned circuit, which has a natural frequency of oscillation with a period equivalent to the on time of the switching elements SCR 18 and bypass diode 24. As will be more fully explained, the series tuned circuit comprising the inductor 44 and capacitor 46 generates a circulating current Ic which biases diode 42 in a conducting condition upon the return pulse of the precipitator 54.

The application of the power supply is illustrated by the waveforms in FIGS. 2–5 and by further reference to FIG. 1, where a triggering pulse 62, as shown in FIG. 2, is applied to the terminal 17 at a time $t_o$. The application of the rising edge of the pulse causes a voltage to be impressed on the gate terminal 16, thereby activating the SCR 18 into conduction. As the SCR conducts, a part of the energy on the capacitor 22 is discharged through the primary of the pulse transformer 36 and surge inductor 34 to produce a primary current pulse. The inductance of the surge inductor 34 is used to limit the rate of current increase during the primary current pulse, and additionally to adjust the natural frequency of the circuit.

The primary current pulse induces in the secondary winding 38 a higher voltage pulse as set by the turns ratio N2/N1 with a current $I_p$, shown in FIG. 3, which is of the same polarity as the primary current pulse. The secondary current pulse, which is of negative polarity, passes through the blocking diode 42 and begins charging the precipitator 54, as shown by the negative going slope of the voltage waveform 66 in FIG. 4. Simultaneously, however, the secondary current pulse forward biases diode 42. This switching action and the charge on capacitor 46 induces in the trap inductor 44 and trap capacitor 46, an undamped oscillation with circulating current $I_c$ which opposes the secondary current pulse $I_p$ as shown in FIG. 3.

The secondary current pulse charges the capacitance of the precipitator 54, such that charge accumulates on the electrodes thereof to increase the voltage across them. The accumulated charge is sufficient to provide a voltage increase with a peak as shown in FIG. 4, which is in excess of the corona discharge threshold 72 causing corona ions to be emitted by the cathode 48. Normally, the peak voltage 70 is slightly less than the charging voltage on capacitor 22 times the turns ratio of the transformer. With capacitor 22 charged to 600 volts and a turns ratio of 100 the peak 70 is then approximately 60 kv.

A return current pulse 60 of opposite polarity is subsequently generated to the secondary winding 38 in the second half cycle from the precipitator 54 in FIG. 3. Normally, this return peak pulse would be blocked by the blocking diode 42 and would prevent the voltage across the precipitator from falling rapidly to the corona threshold voltage. When the return pulse is blocked in this manner, the unused energy on the precipitator 54 decays exponentially, as shown by the dashed lines in FIG. 4 as wasted power. However, in the present application, simultaneously with the return pulse, the trap circuit elements generate a negative pulse of circulating current 61 which provides forward bias for the blocking diode 42, allowing the precipitator return pulse to pass through the diode 42 to the secondary winding 38 of the pulse transformer 40.

Since the return pulse has been transmitted through the blocking diode 42, the voltage on the precipitator is allowed to fall rapidly, as shown by the positive slope 64 of the precipitator voltage waveform in FIG. 4. The return pulse is reflected through the transformer 40 to the primary 36, where it is delivered back to the charging capacitor 22 through the now positively biased diode 24. Further oscillations of the pulse forming portion cease because the SCR 18 becomes nonconducting once the previous primary pulse current finishes its first half cycle. Additionally, in the pulse delivery portion of the circuit, the voltage on the precipitator 54 now has fallen to the corona threshold level and no longer loses energy through ion generation. The precipitator voltage is kept from falling below the corona threshold voltage by the diode 42 blocking further current flow to the secondary of the transformer 38.

As illustrated in FIG. 5, during the charging half-cycle and return half-cycle the voltage across the surge inductance 34 and primary winding 36 remains negative. Initially, the full negative voltage of capacitor 22 is impressed across this combination resulting in the voltage peak 82. As the current builds up in the primary winding 36, the voltage begins to become less negative to peak 84. Then the return pulse of an opposite polarity is reflected back through the primary as the current builds up and the voltage begins to fall to peak 86. At the end of the cycle when current no longer flows through the inductor 34, and primary winding 36 because SCR 18 is nonconducting and diode 24 is back biased, the voltage rises rapidly back to ground level.

However, the negative area under the zero reference represents stored magnetization in the transformer 40 which must be reset so that it does not saturate and lose its ability to transform alternating current. Therefore, the clamping circuit allows the voltage on the elements to rise to a positive level 80 sufficient to reset the elements in time for the next cycle. In other words, the area or time integral of positive voltage level 80 has to be equal or greater than the time integral of the negative voltage of inductor 34 and primary winding 36. Preferably, the voltage 80 is no more than 5–7% of the peak voltage of the capacitor 22.

The charge that is transferred during each cycle is the time integral of the current $Ip^-$ which is delivered during the negative going half-cycle 58, and the charge returned is the time integral of the current $Ip^+$ of the positive going half-cycle 60. The difference between these two quantities, once the precipitator is charged to the ionization threshold, is the amount of charge that crosses the precipitator as corona ionization with each pulse. As can be seen in the FIG. 4, the unused charge which is related to the area between the voltage waveforms 64 and the dashed exponential waveform 68, has been returned to the pulse forming network and is not dissipated as heat in the precipitator 54.

Moreover, because of the narrow pulse width of the voltage on the precipitator, a higher peak 70 may be used to increase collection efficiency without causing a sparking condition. At the peak voltage 70, if the precipitator voltage were allowed to decay more slowly, as shown by the dashed waveform 68, then breakdown of the dielectric between the two electrodes 48 and 50 in the form of a spark is more likely to occur. However, with the power supply of the present invention, the peak is reached rapidly and discharged rapidly such that there is not enough time for a breakdown or spark to occur.

When the voltage waveform in FIG. 4 is compared to the current waveforms in FIG. 3, it is evident that the period of the voltage pulses is equal to that of the primary and secondary current pulses. Since the power supply is resonant, the period of the current pulses Ip is the natural period of the power supply circuit. To find the current pulse frequency of the power supply circuit, it is noted that a series tuned circuit is formed between the primary circuit section and the secondary circuit section. The natural period of the resonation will be:

$$t_n = 2\pi\sqrt{LeCe} \tag{1}$$

where Le is the equivalent inductance of the circuit; Ce is the equivalent capacitance; and tn is the natural period. The equivalent inductance Le is calculated as the series combination of the inductance Ls of surge inductor 34, and leakage inductance Lw of the transformer 40 as reflected to the precipitator through the square of the turns ratio $(N2/N1)^2$. Using this relationship the circuit has an equivalent inductance of:

$$Le = \left(\frac{N2}{N1}\right)^2 (Ls + Lw) \tag{2}$$

The equivalent capacitance is calculated as the series combination of the capacitance Cc of charging capacitor 22; as reflected to the percipitator through the square of the turns ratio $(N1/N2)^2$; and capacitance Cp of the precipitator 54. Using this relationship the circuit has an equivalent capacitance of:

$$Ce = \frac{(N1/N2)^2\, Cc\, Cp}{(N1/N2)^2 Cc + Cp} \quad (3)$$

Combining 1, 2 and 3 yields the following relationship for the natural period:

$$tn = 2\pi \sqrt{\frac{(Ls + Lw)\, Cc\, Cp}{(N1/N2)^2\, Cc + Cp}} \quad (4)$$

The natural period of the series tuned trap circuit comprising the inductor 44 and the capacitor 46 should be substantially equivalent to the natural period of the tuned circuit of the pulse generation and pulse application portion of the power supply. When this is the case, the current waveforms for both circuits peak at approximately the same time and cross through a zero reference t1 (FIG. 2) at approximately the same time thereby creating the forward bias on the blocking diode during both half-cycles of the resonant pulsing.

The natural period of the trap circuit can be found by the equation for resonance:

$$t = 2\pi \sqrt{LtCt} \quad (5)$$

where Lt is the inductance of the trap inductor 44; Ct is the capacitance of the trap capacitor 46; and t is the natural period of the trap circuit. Since it is advantageous that the natural period of both the power supply and trap circuit are equivalent, the following equation, developed by setting the right hand side of equations 4 and 5, equal will be used:

$$LtCt = \frac{(Ls + Lw)\, Cc\, Cp}{(N2/N1)^2\, Cc + Cp} \quad (6)$$

Generally, the capacitance of the precipitator Cp will be dictated by the physical requirements of the installation, and Cc, Ls and Lw chosen to produce the pulse waveform period needed by the system to power the precipitator. The ratio Lt/Ct is then calculated such that the surge impedance is considerably higher than that of the main circuit. The surge impedance of this circuit is chosen to tailor the amplitude of the return current pulse as needed by the precipitator.

The two waveforms are not exact mirror images because the supply oscillation is a damped waveform, with the second half cycle being somewhat less in amplitude than the first half cycle because of the loss of energy due to corona current. The damped nature of the waveform indicates that the power supply circuit will oscillate with a frequency slightly different (lower) than the natural frequency. The substantially undamped waveform of the trap circuit has a relatively constant amplitude over the entire cycle and oscillates at its natural frequency.

Because the charging waveform is damped and the other trap waveform is undamped, the difference (Ip−Ic) between the opposing current pulses is such that the blocking diode 42 is in conduction during the entire period of the charging pulse and return pulse. When Ip is in the negative half cycle or charging pulse portion, Ic is in its positive half cycle and the difference Ip−Ic is negative thereby forward biasing the diode. Additionally, in the next half cycle, where Ip is positive but with a lesser amplitude than the charging pulse, the difference Ip−Ic is still negative because now the amplitude of the second half cycle of Ic is now greater than Ip and negative in polarity. The diode 42 therefore remains in conduction during the second half cycle because the difference Ip−Ic is still negative.

Operation of the circuit will occur in this manner whenever the absolute value of the relatively constant peak amplitude of the trap circuit pulse Ic is greater than the peak amplitude of the second half cycle of the pulse Ip, but is less than the peak amplitude of the first half cycle of the pulse.

Further, it is noted that operation of the power supply circuit in this manner limits the amount of energy which can be discharged as an arc to the charge stored as the precipitator. Only when the switching path is closed can additional energy pulses be provided for charging the precipitator. If the triggering pulses of the SCR 18 are interrupted upon the sensing of an arc, the power supply will be virtually short proof as the only power available to sustain the condition will be that stored on the precipitator. Such conditions will thus be self extinguishing in comparison to power supplies where an arc can cause a substantially unlimited power demand.

In FIG. 6 there is illustrated an alternative embodiment for the pulse forming portion of the power supply illustrated in FIG. 1. A step-up transformer 106 is connected at one terminal to the cathode 108 of a precipitator while the anode 110 of the precipitator while the anode 110 of the precipitator is connected to ground. In parallel between the other terminal of the step-up transformer and ground is coupled a blocking diode 100 and a trap circuit including a capacitor 102 and an inductor 104. The circuit illustrated is a rearrangement of that shown in FIG. 1 where the diode 100 and pulse transformer 106 have had their positions interchanged. The circuit shown in FIG. 6 operates in a manner identical to the circuit shown in FIG. 1 and illustrates there are many rearrangements of the elements described which will perform equivalent operations.

Figure 7:
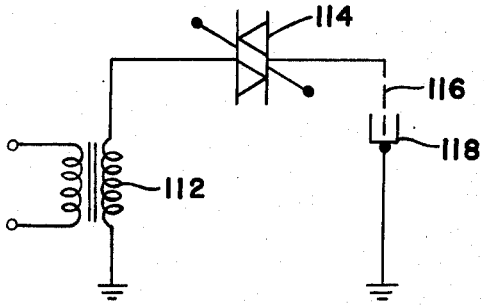

An alternative to the blocking diode and trap circuit is illustrated in FIG. 7. Between a cathode 116 of a precipitator and the secondary winding of a step-up transformer 112 there is shown a bilateral switching device 114. Preferably, the characteristics of the device are those of a voltage triggered bidirectional thyristor. In the drawing this device is illustrated as a TRIAC with floating control terminals so that the triggering of the device will occur because of the rapid rise in voltage (dV/dt) caused by the pulsing. Other devices are available for operation in this manner such as SBS or silicon bilateral switch which is sometimes referred to as a four layer diode.

Relating this implementation to FIGS. 3 and 4, it is seen that when the negative first half cycle pulse 58 occurs a rapid rise in voltage on the secondary of the step-up transformer 112 will cause the device to trigger into conduction. Because of the resonance of the circuit current will continue to flow in the device holding it on through the positive return pulse 60. When current in the cycle is cut off by turning off the SCR 18 (FIG. 1) the lack of current in the secondary loop will cause device 114 to also turn off thereby blocking the charge on precipitator electrodes 116, 118. This operation thus allows the return of unused energy to the primary circuit and also maintains the collection voltage on the precipitator between pulses.

Figure 8:
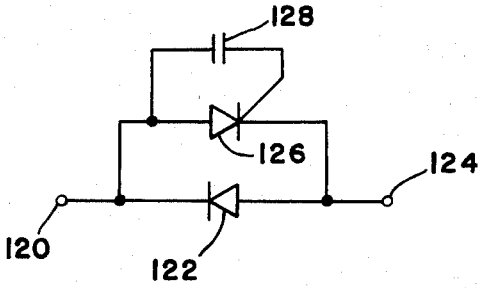

With reference to FIG. 8 there is illustrated another alternative embodiment for the blocking diode and trap circuit. In this illustration a blocking diode 122 is connected as shown in FIG. 1 via terminals 120, 124. In parallel with the diode 122 and poled oppositely thereto is a unidirectional thyristor device 126 which is triggered by a change in voltage (dV/dt). One advantageous device of this type is the RBDT or reverse blocking diode thyristor. In operation, refering to FIGS. 3 and 4 once more, the negative pulse 58 passes through diode 122 and because of the low voltage drop across that element does not fire RBDT 126. However, when the return pulse 60 is initiated and creates a voltage rise because of the blocking action of diode 122, the RBDT 126 is triggered into conduction to provide a low impedance path for its return. Thereafter, because of the switching of the SCR 18 (FIG. 1) in the primary circuit, current in the secondary is extinquished turning off device 126. A capacitor 128 is shown as connected between the gate terminal of the device and its anode to commute the dV/dt variance to the control terminal. Usually there is enough interelectrode capacitance in these devices such that an external capacitance such as capacitor 128 is unnecessary.

Figure 9:
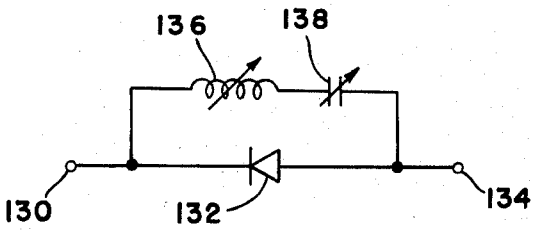
Figure 10:
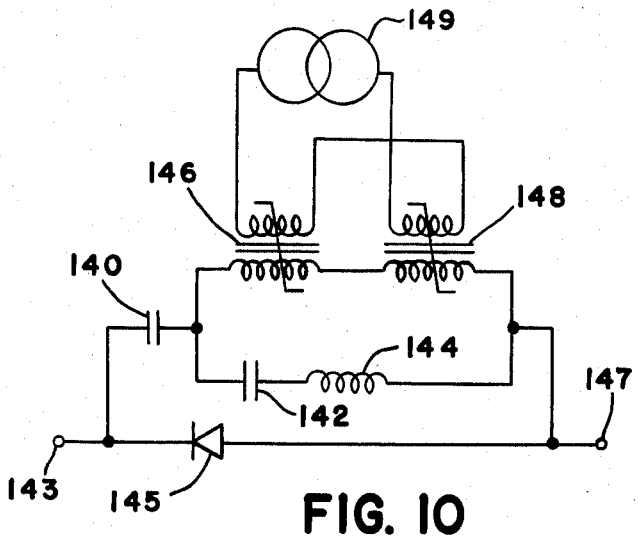
Figure 11:
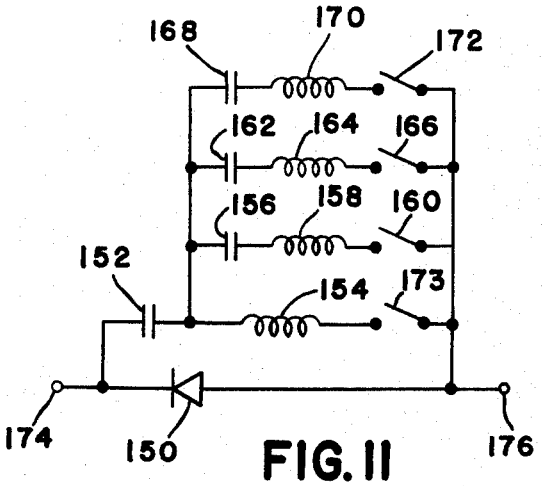

FIGS. 9, 10, and 11 are illustrate embodiments for the blocking diode and the trap circuit where means are provided for varying the trap circuit impedance. As mentioned previously with respect to FIGS. 3 and 4 the amplitude of the return pulse 60 and the level of the collection voltage 72 are controlled by the value of the impedance of the trap circuit.

FIG. 9 illustrates an embodiment where either a trap inductor 136 or a trap capacitor 138, or both, are variable. The circuit is identically connected as in FIG. 1 by terminals 130, 134 and contains blocking diode 132.

A blocking diode 145 is shown in FIG. 10 as connected by terminals 143 and 147 in the manner illustrated in FIG. 1. The trap circuit comprises the series connection of a capacitor 140 and a parallel circuit coupled between the anode and cathode of the diode 145. In one leg of the parallel circuit is a series tuned trap circuit comprising a capacitor 142 and an inductor 144 and in the other leg a pair of series connected saturable reactors 146 and 148. The reactors have bias windings interconnected with a source of de bias current 149. The impedance of the circuit can be varied by providing a varying amount of dc bias current on the saturable reactors 146 and 148. The circuit will illustrate the largest impedance at essentially zero bias where capacitors 140, 142 and inductor 144 dominate because the unsaturated impedance of the reactors is large. As more bias is applied to the reactors the circuit will, as a time average, exhibit an impedance which will decrease to where a minimum is reached. The minimum impedance is essentially calculated from the capacitance of capacitor 140 and the saturated inductance of saturable reactors 146, and 148.

Another arrangement for varying the trap circuit impedance is illustrated in FIG. 11 where blocking diode 150 is connected by terminals 174 and 176 to the step up transformer and precipitator. The trap circuit comprises the serial connection of a capacitor 152 and a multi legged parallel circuit coupled between the anode and cathode of the diode 150. One leg of the parallel circuit consists of an inductor 154 while the other legs comprise alternate series tuned circuits comprising capacitor-inductor pairs 156–158, 162–164, and 168–170 respectively. Switches 160, 166, and 172 connect these tuned circuits into the trap circuit either by manual operation or by controlled switching. Depending upon the desired impedance a series tuned pair can be picked out and the corresponding switch closed.

While the invention has been described in detail in relation to the preferred embodiments, those skilled in the art will understand that other changes in the form and detail can be made therein without departing from the spirit and scope of the invention, wherein all such changes obvious to one skilled in the art are to be encompassed in the following claims.

What is claimed is:

1. An electrostatic precipitator power supply circuit for generating voltage pulses on the precipitator while allowing a residual collection voltage to be retained on the precipitator during intervals between pulses, where the voltage of the pulses is substantially in excess of the residual voltage, said power supply circiut comprising:

means for generating said high voltage pulses at the secondary inductance of a step-up transformer by discharging a capacitor through the primary inductance of a the step-up transformer;

said electrostatic precipitator connected to the secondary inductance of said step-up transformer to receive said high voltage pulses; and means for returning a portion of said high voltage pulses to said capacitor, and for maintaining said residual voltage on the precipitator during interpulse periods including means with a variable impedance adapted for providing a maximum impedance during interpulse periods and a minimum impedance during high voltage pulses and means for causing said variable impedance means to exhibit a minimum impedance during said return of a portion of said high voltage pulses.

2. A power supply circuit as defined in claim 1 wherein said variable impedance means includes:

a unidirectional circuit element exhibiting at predetermined times a minimum impedance to one polarity of voltage and at other predetermined times a maximum impedance to another polarity of voltage.

3. A power supply circuit as defined in claim 1 wherein said variable impedance means includes:

a unidirectional circuit element exhibiting at predetermined times a minimum impedance to one polarity of current and at other predetermined times a maximum impedance to another polarity of current.

4. A power supply circuit as defined in claim 2 wherein:

said unidirectional circuit element is a diode.

5. A power supply circuit as defined in claim 3 wherein:

said unidirectional circuit element is a diode.

6. A power supply circuit as defined in claim 1 wherein:

said variable impedance means is a diode; and said means for causing said variable impedance means to exhibit a minimum impedance is a series tuned circuit comprising a capacitor and inductor having a natural frequency of oscillation.

7. A power supply circuit as defined in claim 6 wherein:

said discharging capacitor, said primary inductance, said secondary inductance, and said precipitor form a series tuned circuit having a natural frequency of oscillation.

8. A power supply circuit as defined in claim 7 wherein said means for generating high voltage pulse include:

means for limiting said natural frequency to one cycle of oscillation where during the first half-cycle energy is supplied to said precipitator and where during the second half-cycle energy is returned to said discharging capacitor.

9. A power supply circuit as defined in claim 8 wherein:

the natural frequency of the power supply tuned circuit is substantially equivalent to the natural frequency of the means for causing said variable impedance to exhibit a minimum impedance.

10. A power supply circuit as defined in claim 9 wherein:

the one cycle of oscillation of the power supply is damped, and the oscillation of said causing means in undamped;

wherein said amplitude of the undamped oscillation is greater than the amplitude of the damped half-cycle of the damped oscillation but less than the amplitude of the undamped half-cycle of the damped oscillation.

11. A pulsed power source for an electrostatic precipitator having a corona electrode which provides an ionizing source of electrons when it attains a potential in excess of a discharge voltage, and a collecting electrode which is adapted to collect ionized particulates passing between the ionizing source and the collection electrode, said power source comprising:

a current source for charging an energy storage element with a predetermined amount of charge;

a pulse transformer with a primary and a secondary, said transformer being connected through its primary to said energy storage element such that discharge of said storage element will produce a primary current pulse in said primary;

means interposed between the primary of said pulse transformer and said energy storage element, for connecting a conduction path between said energy storage element and said primary for causing the generation of said primary current pulse;

means for triggering said connecting means into conduction periodically said secondary being electrically connected to the precipitator electrodes, wherein said primary current pulse induces in said secondary a secondary current pulse which is coupled to said precipitator to charge said electrodes and create a voltage difference across them and wherein said voltage difference being in excess of said discharge voltage;

said precipipitator thereafter creating a return current pulse thereby lowering the voltage difference below the discharge voltage; and bidirectional conduction means, interposed between the secondary of said pulse transformer and said precipitator electrodes, providing a low impedance conduction path during said secondary current pulse and during a return current pulse and a high impedance conduction path otherwise, and including a unidirectional current element allowing current to flow between the secondary of said pulse transformer and said precipitator only when said current element is positively biased.

12. A pulsed power source as defined in claim 11 wherein said bidirectional conduction means further includes:

means for generating positive bias for said unidirectional current element during the return current pulse.

13. A pulsed power source as defined in claim 12 wherein:

said unidirectional current element is a diode; and said forward bias generating means is a tuned circuit connected across the anode and cathode terminals of said diode.

14. A pulsed power source as defined in claim 13 wherein:

said tuned circuit resonates with a period which is substantially equivalent to the period of said primary current pulse.

15. A pulsed power source as defined in claim 11 wherein:

said bidirectional conduction means includes a variable inductor.

16. A pulsed power source as defined in claim 15 wherein:

said bidirectional conduction means includes a variable capacitor.

17. A pulsed power source as defined in claim 11 where said bidirectional conduction means includes:

said unidirectional current element transmitting current pulses of one polarity and blocking current pulses of the opposite polarity; and a unidirectional switching device, poled oppositely to said unidirectional current element, which is adapted to be triggered on the change in voltage with respect to time on one power terminal, said switching device connected such that the current pulses blocked by said unidirectional current element are transmitted therethrough.

18. A pulsed power source as defined in claim 11 wherein said bidirectional conduction means further includes:

a diode as said unidirectional current element for transmitting current pulses of one polarity and for blocking current pulses of the opposite polarity;

a tuned circuit coupled in parallel with said diode for maintaining a forward bias on said diode during said opposite polarity pulses; and means for varying the impedance of said tuned circuit.

19. A pulsed power source as defined in claim 18 wherein said tuned circuit comprises:

a capacitor coupled in series with a second tuned circuit comprising a second capacitor and a second inductor;

first and second saturable reactors, coupled in parallel with said second tuned circuit and in series with each other; said first and second saturable reactors adapted to vary their impedance based upon a bias signal and thereby vary the impedance of said second tuned circuit.

20. A pulsed power supply as defined in claim 18 wherein said tuned circuit comprises:

a capacitor coupled in series with a parallel circuit;

said parallel circuit comprises of a plurality of legs where each leg includes at least one other tuned circuit and a switch to connect the other tuned circuit to said capacitor; wherein the closure of the switches of the legs varies the impedance of the tuned circuit.

21. A pulsed power source for an electrostatic precipitator, said power source comprising:

a first resonant circuit periodically providing single damped oscillations of current and voltage to the electrostatic precipitator;

the electrostatic precipitator included as a load capacitance reflected through a pulse transformer forming one portion of said resonant circuit;

a blocking diode interposed between the electrostatic precipitator and a secondary winding of said pulse transformer in said one portion of said resonant circuit for passing said damped oscillations to and from said precipitator and for maintaining a residual voltage between oscillations;

a second resonant circuit providing single undamped oscillations of recirculation current in response to said damped oscillations; and said second resonant circuit being connected to said blocking diode such that said recirculation current maintains said blocking diode in conduction during said damped oscillations.

22. A pulsed power source as defined in claim 21 wherein said first resonant circuit comprises:

a charging capacitor connected in a series relationship with a surge inductor and a primary winding of said pulse transformer, and said precipitator connected in a series relationship with the secondary winding of said pulse transformer.

23. A pulsed power source as defined in claim 22 wherein said source further includes:

switching means for periodically discharging a predetermined amount of energy stored in said charging capacitor to generate said periodic damped power oscillations.

24. A pulsed power source as defined in claim 22 wherein the period tn of said damped oscillations is approximately:

$$tn = 2\pi \sqrt{\frac{(Ls + Lw)\, Cc\, Cp}{(N2/N1)^2\, Cc + Cp}}$$

where tn = the period of the natural frequency of the oscillations

N2/N1 = turns ratio of the transformer

Ls = inductance of the surge inductor

Lw = inductance of the primary winding

Cc = capacitance of the charging capacitor, and

Cp = capacitance of the precipitator.

25. A pulsed power source as defined in claim 21 wherein said second resonant circuit comprises:

a trap inductor connected in a series relationship with a trap capacitor.

26. A pulsed power source as defined in claim 21 wherein:

the period of said undamped oscillations is substantially equivalent to the period of said damped oscillations.

27. A pulsed power source as defined in claim 22 further including:

a clamping circuit, connected in parallel across said surge inductor and the primary winding of said pulse transformer, for preventing or limiting voltage overshoot in said primary winding after said single oscillations.

28. A pulsed power source as defined in claim 25 wherein the period t of said undamped oscillations is approximately:

$$t = 2\pi \sqrt{LtCt}$$

where t = the period of the natural frequency of the oscillations

Lt = inductance of the trap inductor, and

Ct = capacitance of the trap capacitor.

29. A pulsed power source for an electrostatic precipitator having a corona electrode which provides an ionizing source of electrons when it attains a potential in excess of a discharge voltage, and a collecting electrode which is adapted to collect ionized particulates passing between the ionizing source and the collection electrode, said power source comprising:

a current source for charging an energy storage element with a predetermined amount of charge;

a pulse transformer with a primary and a secondary, said transformer being connected through its primary to said energy storage element such that discharge of said storage element will produce a primary current pulse in said primary;

means interposed between the primary of said pulse transformer and said energy storage element, for connecting a conduction path between said energy storage element and said primary for causing the generation of said primary current pulse;

means for triggering said connecting means into conduction periodically;

said secondary being electrically connected to the precipitator electrodes, wherein said primary current pulse induces in said secondary a secondary current pulse which is coupled to said precipitator to charge said electrodes and create a voltage difference across them and wherein said voltage difference is in excess of said discharge voltage;

said precipipitator thereafter creating a return current pulse thereby lowering the voltage difference below the discharge voltage; and bidirectional conduction means, interposed between the secondary of said pulse transformer and said precipitator electrodes, providing a low impedance conduction path during said secondary current pulse and during a return current pulse and a high impedance conduction path otherwise, and including a bilateral switching device which is adapted to be triggered by the change in voltage with respect to time as measured on either power terminal of the device.

30. A pulsed power source for an electrostatic precipitator having a corona electrode which provides an ionizing source of electrons when it attains a potential in excess of a discharge voltage, and a collecting electrode which is adapted to collect ionized particulates passing between the ionizing source and the collection electrode, said power source comprising:

a current source for charging an energy storage element with a predetermined amount of charge;

a pulse transformer with a primary and a secondary, said transformer being connected through its primary to said energy storage element such that discharge of said storage element will produce a primary current pulse in said primary;

means, interposed between the primary of said pulse transformer and said energy storage element, for connecting a conduction path between said energy storage element and said primary for causing the generation of said primary current pulse;

means, for triggering said connecting means into conduction periodically;

said secondary being electrically connected to the precipitator electrodes, wherein said primary current pulse induces in said secondary a secondary current pulse which is coupled to said precipitator to charge said electrodes and create a voltage difference across them; said voltage difference being in excess of said discharge voltage;

said precipipitator thereafter creating a return current pulse thereby lowering the voltage difference below the discharge voltage; and bidirectional conduction means interposed between the secondary of said pulse transformer and said precipitator electrodes providing a low impedance conduction path during said secondary current pulse and during a return current pulse, and a high impedance conduction path otherwise.

* * * * *

UNITED STATES PATENT AND TRADEMARK OFFICE

CERTIFICATE OF CORRECTION

PATENT NO. : 4,600,411

DATED : July 15, 1986

INVENTOR(S) : George T. Santamaria

It is certified that error appears in the above-identified patent and that said Letters Patent is hereby corrected as shown below:

Column 1, Line 55, change "supplys" to --supplies--.

Column 2, Line 36, change "maintan" to --maintain--.

Column 6, Line 41, change "Ic" to --$I_c$--.

Column 8, Line 50, change "tn" to --$t_n$--.

Column 9, Line 19, change bold face "tl" to normal type --tl--.

Column 9, Line 60, change "(Ip-Ic)" to --($I_p$-$I_c$)--.

Column 9, Line 63, change "Ip" to --$I_p$--.

Column 9, Line 65, change "Ic" to --$I_c$--.

Column 9, Line 65, change "Ip-Ic" to --($I_p$-$I_c$)--.

Column 9, Line 67, change "Ip" to --$I_p$--.

Column 10, Line 1, change "Ip-Ic" to --($I_p$-$I_c$)--.

Column 10, Line 2, change "Ic" to --$I_c$--; and change "Ip" to --$I_p$--.

Column 10, Line 5, change "Ip-Ic" to --($I_p$-$I_c$)--.

Column 10, Line 8, change "Ic" to --$I_c$--.

Column 10, Line 10, change "Ip" to --$I_p$--.

Column 10, Lines 30-31, after "precipitator" delete "while the anode 110 of the precipitator".

UNITED STATES PATENT AND TRADEMARK OFFICE

CERTIFICATE OF CORRECTION

PATENT NO. : 4,600,411

DATED : July 15, 1986

INVENTOR(S) : George T. Santamaria

It is certified that error appears in the above-identified patent and that said Letters Patent is hereby corrected as shown below:

Column 11, Line 25, before "illustrate" delete "are".

Column 11, Line 45, change "de" to --dc--.

Column 18, Line 3, change "precipipitator" to --precipitator--.

Column 12, Line 18, change "circiut" to --circuit--.

Column 12, Line 22, after "of" delete "a".

Column 12, Line 66, change "precipitor" to --precipitator--.

Column 13, Line 19, change "in" to --is--.

Column 13, Line 45, after "periodically" insert -- ; -- (semi-colon).

Column 13, Line 53, change "precipipitator" to --precipitator--.

Column 14, Line 61, after "comprises" delete "of".

Column 16, Line 39, change "precipipitator" to --precipitator--.

Signed and Sealed this

Sixteenth Day of December, 1986

*Attest:*

DONALD J. QUIGG

*Attesting Officer* *Commissioner of Patents and Trademarks*